US005592844A

United States Patent [19]

Baumgartner

[11] Patent Number: 5,592,844

[45] Date of Patent: Jan. 14, 1997

[54] PROCESS AND APPARATUS FOR ROUNDING SHEET-METAL BLANKS

[75] Inventor: Michael Baumgartner, Rekingen, Switzerland

[73] Assignee: Elpatronic AG, Zug, Switzerland

[21] Appl. No.: 496,532

[22] Filed: Jun. 29, 1995

[30] Foreign Application Priority Data

Aug. 10, 1994 [CH] Switzerland ..... 2473/94
Oct. 31, 1994 [CH] Switzerland ..... 3242/94

[51] Int. Cl.[6] ..... B21B 39/02; B21D 5/14; B21D 9/10

[52] U.S. Cl. ..... 72/133; 72/169; 72/171

[58] Field of Search ..... 72/133, 134, 169, 72/170, 171, 172, 173, 174, 175, 426, 428

[56] References Cited

U.S. PATENT DOCUMENTS

| | | | |
|---|---|---|---|
| 2,719,562 | 10/1955 | Beegle | 153/54 |
| 4,856,312 | 8/1989 | Alznauer | 72/133 |
| 4,870,241 | 9/1989 | Gysi | 219/64 |
| 5,120,177 | 6/1992 | Steiger | 413/72 |

FOREIGN PATENT DOCUMENTS

| | | |
|---|---|---|
| 815979 | 7/1937 | France . |
| 3928959 | 8/1990 | Germany . |
| 0289744 | 11/1988 | Switzerland . |

*Primary Examiner*—Daniel C. Crane
*Assistant Examiner*—Rodney Butler
*Attorney, Agent, or Firm*—McCormick, Paulding & Huber

[57] ABSTRACT

Sheet-metal blanks are fed in succession one immediately after another to a rounding apparatus in which they are plastically deformed into a curve in a rounding mechanism and are given a desired constant bending radius. The portion of the blank initially running out of the rounding mechanism in the natural rounding position is deflected by guide means under elastic deformation out of the rounding position into a transfer position which is different from the rounding position and is thereby elastically deformed so that the portion of the blank running out of the rounding mechanism is kept under stress. When the end portion of the sheet-metal blank leaves the rounding mechanism, it springs into the transfer position due to said stress, leaving the way clear for another sheet-metal blank, which can already be in the process of being rounded before the fully rounded sheet-metal blank is ejected from the rounding apparatus and conveyed away. This allows the cycle time for the rounding process to be reduced in a simple manner without impairment of rounding quality.

21 Claims, 3 Drawing Sheets

PROCESS AND APPARATUS FOR ROUNDING SHEET-METAL BLANKS

BACKGROUND OF THE INVENTION

The invention relates to a process and an apparatus, according to the corresponding claims, for rounding sheet-metal blanks.

In the state of the art, flat rectangular or square sheet-metal blanks e.g. for the manufacture of can bodies are rounded and the two edges extending axially and parallel with one another are then welded together, thus forming the sheet-metal blank into a cylindrical shell.

For the rounding, the sheet-metal blank is shaped into a curve in a rounding means, for example by being guided by a wedge to an inner bending roll and being passed immediately thereafter through a pinch point between the inner bending roll and an outer bending roll with these two rolls pressed together. This bends the initially flat blank about a constant bending radius so that the portion of the blank emerging from the pinch point no longer advances in a straight line in the original feed direction, but runs in a curve into a natural rounding position on the bending circle defined by the bending radius. In the case of can body manufacture, the curved blank passes essentially around the entire bending circle so that the blank is presented in the rounding position as an almost closed cylindrical shell. In practice the bending circle or rounding position may be slightly deformed by the weight and elasticity of the curved blank, but this can be prevented by providing guide means for the rounded portion of the blank.

The radius of the bending circle is determined by the radius of the inner bending roll, by the position of the wedge, and by the elasticity of the sheet material (sheet thickness and limit of elasticity). For can body manufacture, it is usually made somewhat smaller than the radius of the can body after welding, so that the rounded blank forms a cylindrical shell with the axial edges slightly overlapping.

The guide means for the rounded portion of the blank usually comprise an essentially cylindrical inner rounding mandrel and an essentially hollow-cylindrical outer guide, with the intervening space defining the circular slot lying on the bending circle. After rounding is complete, the shell is ejected axially from the circular slot, and another blank is inserted into the bending machine and into the circular slot.

The cycle time required for rounding a sheet-metal blank by the known process described above is made up of the time required for rounding and the time required for rejection. The rounding time is determined by the rate of feed and the length of the blank to be rounded. The ejection time is determined inter alia by the axial length of the rounded blank. In other words, the blanks have to be fed to the rounding means spaced apart at a minimum interval which is governed not by the rounding operation itself, but by the axial length of the rounded blank and by the ejection mechanism employed.

SUMMARY OF THE INVENTION

The object of the present invention is to reduce the rounding cycle time. It is desirable that this should be accomplished without any reduction in rounding quality, and without requiring any significant increase in equipment cost, e.g. in respect of a faster ejection mechanism. This object can be achieved by the process and device defined in the corresponding claims.

By shifting the rear end portion of the rounded blank into a transfer position which is different from the rounding position, room is made for the leading portion of the next blank to run into the rounding position even though the previous blank has not yet left, or has not yet completely left, the rounding means. It is therefore no longer necessary to wait until the rounding means has been emptied before feeding the next blank into the means, which makes it possible to shorten the minimum interval between blanks at a given rate of feed, and hence to reduce the overall cycle time.

In apparatus for carrying out this process, means are provided for shifting the rear portion of the rounded blank into the transfer position. This is made possible by elastic deformation of the leading portion of the rounded blank by the guide means, so that the rear portion of the blank being rounded is under load, and springs into the transfer position as soon as it is released from the pinch point. Alternatively, the blank can be abruptly arrested immediately after completion of the rounding operation, so that the rear portion is thrown by its own inertia out of the rounding position into the transfer position.

BRIEF DESCRIPTION OF THE DRAWINGS

Examples of the process and apparatus according to the invention will now be described with reference to the accompanying drawings, in which.

DESCRIPTION OF THE PREFERRED EMBODIMENTS

Figure 1A:
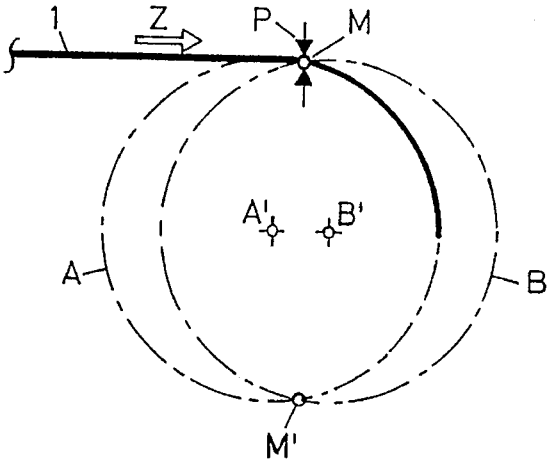
FIGS. 1*a* to 1*c* are diagrammatic views of a rounding process according to the invention in three successive phases.

As shown in FIG. 1*a*, a sheet-metal blank 1 is fed, in a direction Z, to a pinch point P (indicated by a double arrow) of a rounding mechanism, which is not itself illustrated in FIG. 1*a*. Rounding mechanisms are in themselves known; an example of such a mechanism, which forms part of a rounding apparatus 80 illustrated in FIGS. 2 and 3, will be described in detail later with reference to FIG. 3. In the rounding mechanism, the sheet-metal blank 1, which has been flat up to this point, is plastically formed into a curve so that it has the desired constant bending radius after leaving the pinch point P. The leading, curved portion of the sheet-metal blank 1 runs into a natural rounding position after leaving the pinch point P; the corresponding bending circle is chain-dotted in FIG. 1*a* and is identified as circle A.

In addition to the bending circle A, an ejection circle B is shown as a chain-dotted circle in FIG. 1*a* and in all the other figures. The centre B' of the ejection circle B is offset in the direction Z with respect to the centre A' of the bending circle A. The points of intersection of the two circles A and B are designated M,M'. The ejection circle B defines a transfer position for the fully rounded sheet-metal blank 1; as soon as the blank 1 is in this transfer position (how this happens will be described presently), it can be ejected from the rounding apparatus in the axial direction, i.e. perpendicularly to the plane of the drawing, by means of an ejection mechanism which is likewise known in itself and is not illustrated in detail in the drawing, and can be conveyed for example to a welding station, which does not form part of the subject-matter of the present invention.

FIG. 1*a* illustrates a phase in which the leading portion of the sheet-metal blank 1 has passed through the pinch point P and has been plastically deformed and is running into its rounding position on the bending circle A.

In the phase shown in FIG. 1*b*, the blank 1 is being diverted at the point of intersection M' out of the bending circle A into the ejection circle B (which does not correspond to the rounding position), in a manner which will be described later with reference to FIG. 2. The rear region of the blank 1 is still gripped by the pinch point P, and, as a result, the portion of the blank lying between the pinch point P and the point of intersection M' is elastically deformed.

Figure 1B:
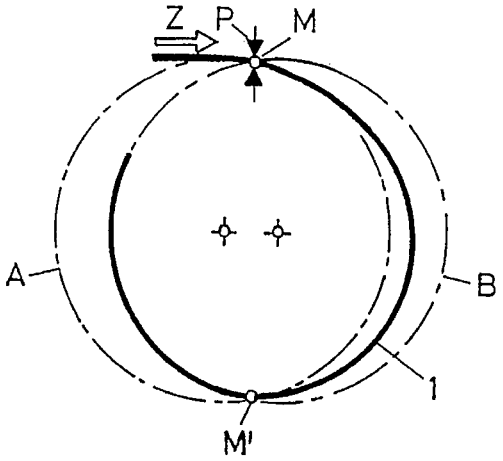
Figure 1C:
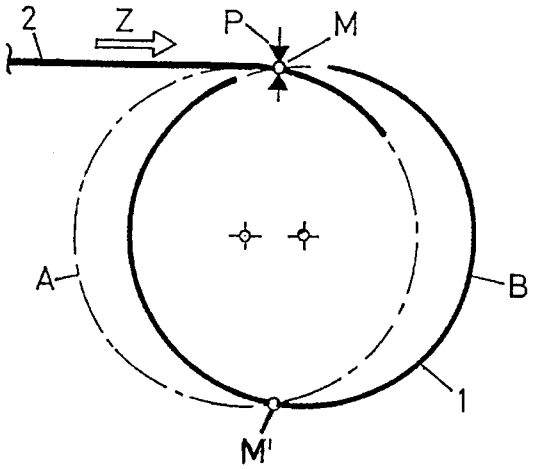

FIG. 1*c* illustrates the position of the blank 1 shortly after the rounding operation is completed. Owing to the elastic deformation of the leading portion of the blank, which lies on the ejection circle B, the rear portion, as it is no longer being held by the pinch point P in the region of the bending circle A, has also sprung into the region of the ejection circle B, so that the whole blank 1 is now lying on the ejection circle B, that is to say in the transfer position. The blank 1 can now be ejected axially from the rounding apparatus. At the same time the next sheet-metal blank 2 is already in the process of being rounded and its leading portion is running into its rounding position on the bending circle A, which has been vacated in good time, since the rear portion of the blank 1 now lies on the ejection circle B. The blank 1 does not need to be ejected from the rounding apparatus until the leading edge of the blank 2 reaches the point of intersection M'.

The geometrical proportions illustrated in FIGS. 1*a*–1*c* are by way of example only. For instance, depending on whether more or less room is to be left for the next blank, the preceding blank may be deflected from the bending circle at a later or earlier moment; also, it is not strictly necessary (though it is favourable) to adopt as the ejection circle B a circle as such, or a circle with the same radius of curvature as the bending circle A.

Figure 2:
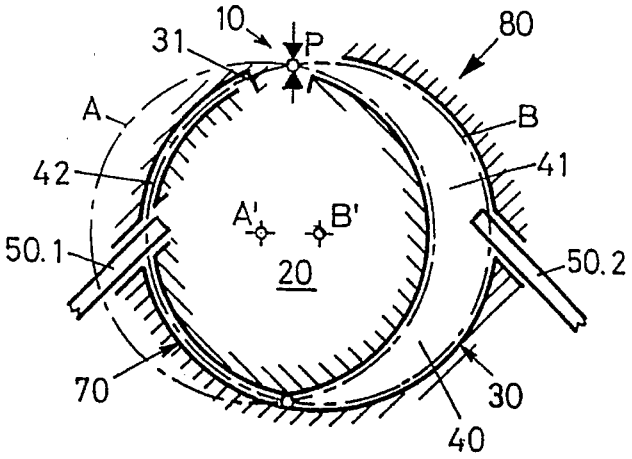
FIG. 2 is a diagrammatic illustration in cross-section of an apparatus for carrying out the process according to FIGS. 1*a* to 1*c;*

FIG. 2 shows in schematic and highly simplified form a rounding apparatus 80 for carrying out the process according to FIGS. 1*a* to 1*c*. The rounding apparatus 80 has a rounding mechanism 10 with the abovementioned pinch point P allotted to the bending circle A. The actual rounding mechanism 10, which is known in itself, is not illustrated in detail in FIG. 2, for the sake of simplicity. The rounding apparatus 80 also has guide means 70 for guiding the rounded sheet-metal blanks 1, 2. An inner rounding mandret 20 and an outer guide 30 together form a circular slot 40 which is terminated by an end stop 31. The rounding apparatus 80 is also provided with the abovementioned ejection mechanism aligned on the ejection circle B, of which only two ejector dogs 50.1 and 50.2 are illustrated in FIG. 2. The ejector dogs 50.1 and 50.2 operate in an axial direction, i.e. perpendicularly to the plane of the drawing. Suitable recesses 22, 37, 36 are provided for the ejector dogs 50.1 and 50.2 in the guide surfaces of the inner rounding mandrel 20 and outer guide 30 respectively. Other ejection means could be used instead of the ejector dogs 50.1, 50.2.

The circular slot 40 has two segments 41, 42. The first segment 41 allows the sheet-metal blank 1 or 2 to run into its rounding position; hence it corresponds to the rounding position and contains a segment of the bending circle A; it ends at the point of intersection M' of the two circles A and B. The second segment 42 starts at the point of intersection M', contains a segment of the ejection circle B and ends at the end stop 31. The segments 41, 42 are bounded by the inner mandrel 20 and the outer guide 30. The cross-section of the inner rounding mandrel 20 is lemon-shaped, corresponding to the region of overlap of the circles A and B. The outer guide 30 is essentially in the form of a hollow cylinder and its cross-section follows the ejection circle B.

The offset between the bending circle A and the ejection circle B (i.e. the distance between the centres A' and B' of the circles) may be selected so that a sheet-metal blank 1 or 2 running in on the bending circle A does not clash with the entry-end ejector dog 50.2.

The rounding process which has been described with reference to FIGS. 1*a* to 1*c*, and which can be performed with a device according to FIG. 2, constitutes the simplest version of the process according to the invention, and requires minimal guide surfaces in the region of the circular slot 40 (in theory, they are only required for the end guide after the point of intersection M'). It is a version which can be used for sheet-metal blanks of sufficient inherent stability and elasticity. The inherent stability is essentially governed by the modulus of elasticity of the sheet material employed, on the thickness of the sheet and the size of the blank, and on the required bending radius. For rounding sheet-metal blanks of relatively low inherent stability (e.g. of thin sheet), it is advantageous to provide further guide means, especially for the initial phase of rounding and for the end phase. A process which has been developed on these lines, and a corresponding device, will now be described with reference to FIGS. 3 to 9.

Figure 3:
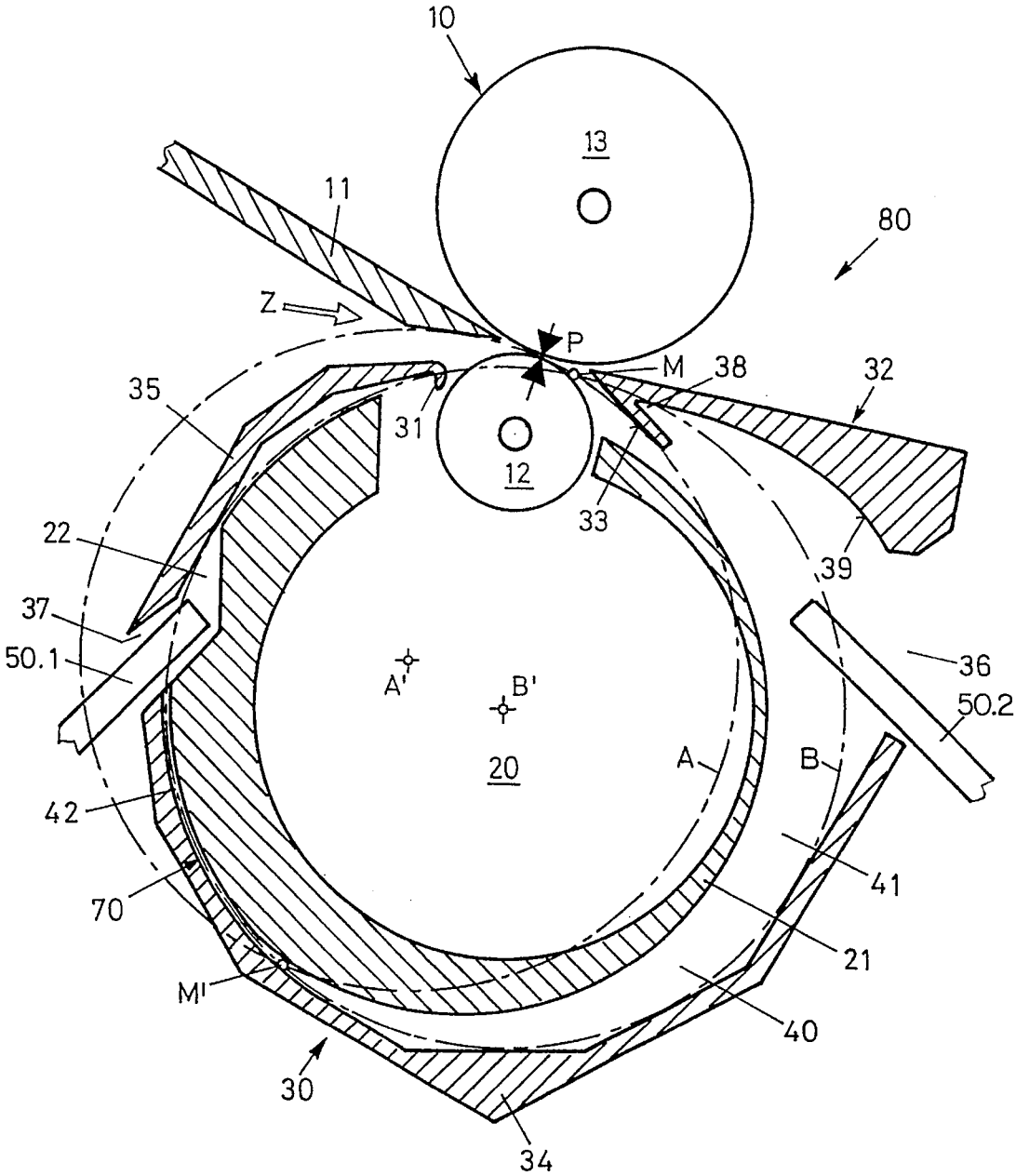
FIG. 3 shows in cross-section a further embodiment of apparatus for carrying out the process according to the invention.

FIG. 3 illustrates a further embodiment of apparatus according to the invention for rounding sheet-metal blanks. Elements already known from previous figures and having equivalent functions are designated by the same reference numbers.

As seen in FIG. 3 the rounding mechanism 10 comprises a wedge 11, an inner bending roll 12 and an outer bending roll 13. The two bending rolls 12, 13 are pressed against one another and act on the sheet-metal blanks (not shown in FIG. 3) which are inserted between them along a line perpendicular to the plane of the drawing (at pinch point P) so that the blanks, which were initially flat, are curved about the desired constant radius—corresponding to the bending circle A.

The outer guide 30 has a middle portion 34 and an end portion 35 which carries the end stop 31. The outer guide 30 is also fitted with a holdback element 32. The holdback element 32 is provided with a guide surface 33, a hook-shaped catch groove 38 and a curved support surface 39. The mode of operation of the holdback element 32 will be described presently with reference to FIGS. 6 to 9. Between the holdback element 32 and the middle portion 34, and between the middle portion 34 and the end portion 35, recesses 36 and 37, respectively, are arranged, in which the ejector dogs 50.1 and 50.2 move. The recess in the inner rounding mandrel 20 opposite the recess 37 is identified by the reference number 22. All the guide surfaces of the outer guide 30 which face inwards towards the circular slot 40 lie outside the ejection circle B, which defines the transfer position for the fully rounded blank. As depicted in FIG. 3, these guide surfaces are formed in a polygonal configuration.

The inner rounding mandrel 20 in this embodiment has a region 21 projecting beyond the bending circle A into the circular slot 40.

The mode of operation of the apparatus according to FIG. 3 will now be described with reference to FIGS. 4 to 9, which schematically illustrate, in a similar fashion to FIGS. 1*a* to 1*c*, a further version of the process according to the invention which can be carried out on this apparatus, but this time in six successive phases. Those guide surfaces which are active in the phase concerned are shown with hatching, and are designated by the reference numbers used in FIG. 3 for the corresponding parts of the device, with the addition of a dash (').

Figure 4:
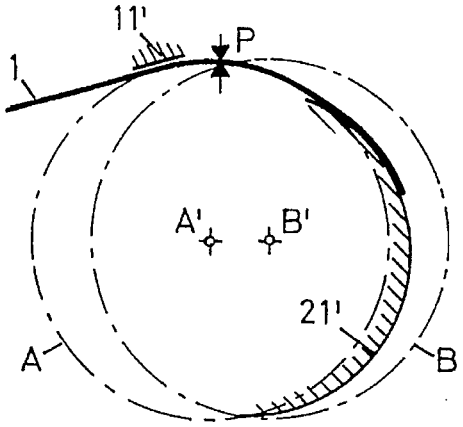
FIGS. 4 to 9 show schematically, in six phases, a further version of the process according to the invention which can be performed in apparatus according to FIG. 3.

In FIG. 4, the leading portion of the sheet-metal blank 1 has already passed through the pinch point P and is being guided by the region 21 of the inner mandrel 20 projecting beyond the bending circle A. The rounding portion of the blank is thereby slightly deformed and, owing to its elasticity, is pressed against the guide surface 21'. Even though it is being guided on one side only, the result is that the leading portion of the blank is precisely located. The guide surface 11' of the wedge is also active in this phase.

Figure 5:
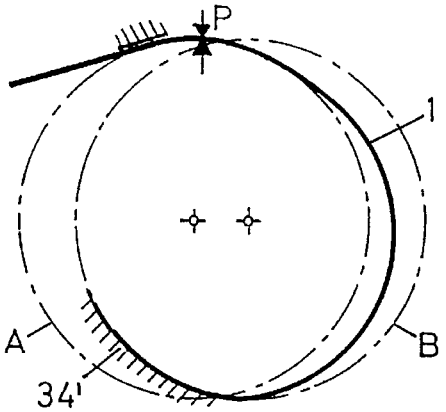

In FIG. 5, the leading portion of the sheet-metal blank 1 has reached the second segment 42 of the circular slot 40 (FIG. 3), where it is being guided along the ejection circle B mainly by the outer guide surface 34', causing it to lift away from the guide surface 21'.

Figure 6:
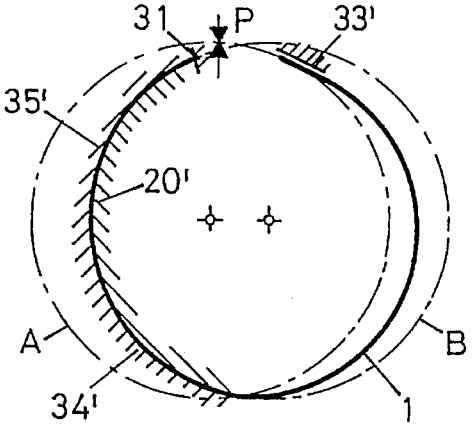

FIG. 6 shows the phase of the rounding process immediately after the trailing edge of the rounded blank 1 leaves the pinch point P. The end region of the blank 1 is still being guided on the bending circle A by the guide surface 33' of the holdback element 32. Owing to its kinetic energy, the blank 1 continues moving in the circular slot 40, guided on the ejection circle B by the inner and outer guide surfaces 20', 34', 35' of the inner mandrel 20 and the outer guide 30 respectively. The guide surface 33 of the holdback element 32 is designed so ,that the trailing edge of the blank 1 has not yet reached the end of the guide surface when the leading edge hits the end stop 31.

Figure 7:
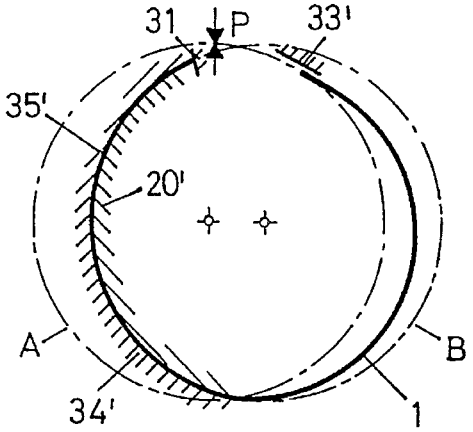
Figure 8:
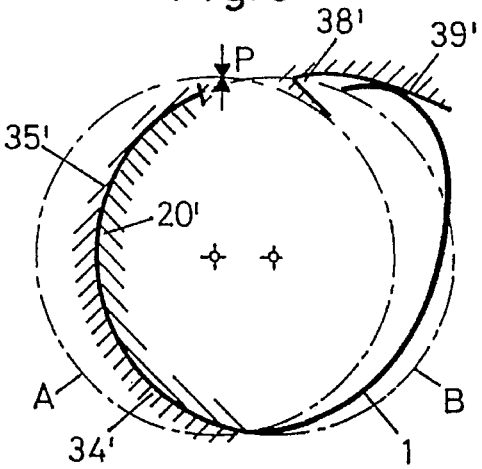

FIGS. 7 and 8 show how the blank 1 is jolted by the effect of impact on the end stop 31 (FIG. 7), causing the trailing edge of the blank 1 to slip past the guide surface 33', whereupon the trailing portion of the blank 1 snaps back towards the ejection circle B (FIG. 8). It is likely that the trailing portion will spring beyond the ejection circle B, and it is advantageous to limit this springy movement by the curved support surface 39' of the holdback element 32. If the blank 1 is severely jolted by the impact on the end stop 31, it is advantageous to give the outer guide surfaces 34' and 35' a polygonal configuration as shown in FIG. 3, to allow the blank 1 to be deflected outwards (and to spring back in again) in the enlargements created in the circular slot 40.

In an embodiment which is not illustrated, the sheet advances on the bending circle A until it is abruptly arrested by an end stop or other suitable means, whereupon the rear end slips past the surface 33' entirely because of its kinetic energy, and engages in the holdback element. In principle, elastic deformation of the leading portion of the blank is no longer required, but may be provided as a back-up.

Figure 9:
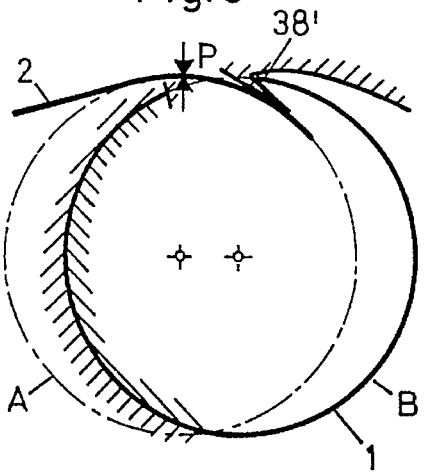

FIG. 9 shows the final phase forming the ejection phase. The rear end of the sheet-metal blank 1, which has been trapped and sprung back by the support surface 39', is prevented from further return movement by, and is caught in, the hook-shaped catch groove 38', which lies on the ejection circle B. Hence another sheet-metal blank 2 can already be advancing unobstructed over the guide surface 33 of the holdback element 32 at the start of the bending circle A. The fully rounded blank 1, whose position is now precisely defined, can be ejected from the circular slot 40. Easy ejection is advantageously assisted by the polygonal configuration of the outer guide 30.

As has already been mentioned, the process according to FIGS. 4 to 9 is advantageous for blanks with relatively low inherent rigidity, in view of the additional guidance in the entry zone and the guidance of the trailing edge in the end zone. It is apparent, particularly from FIGS. 7 to 9, that the process according to this version (in contrast to the version according to FIGS. 1*a* to 1*c*) utilizes not only the spring tension of the rounded blank but also its kinetic energy to shift the trailing portion on to the ejection circle B, i.e. into the transfer position. For this reason, this process is also preferable for less springy blanks.

A further possible technique in accordance with the invention is based on the idea of using only the kinetic energy of the trailing portion of the blank derived from the abrupt stopping of the blank's advance to bring about the elastic deformation of the blank and the resulting shift into the transfer position of the end portion released from the pinch point P, without elastically deforming the leading portion of the blank beforehand. All that is necessary in order to carry out this version, which is not illustrated in the drawing as such, is an end stop located in front of the pinch point P and a holdback element allotted to the transfer position, for example in the form of the holdback element 32 known from FIG. 3.

Besides the illustrated offset in the feed direction Z of the ejection circle B defining the transfer position and the corresponding elastic deformation of the leading portion of the blank inwards, an altogether different transfer position could be adopted; for example, instead of the outer guide 30, an inner guide, e.g. a suitably shaped inner rounding mandrel, could deflect the leading portion of the blank outwards and thereby elastically deform it, in which case the end portion upon leaving the rounding mechanism 10 would also snap into the transfer position lying inside the rounding position, vacating the rounding position for the next incoming blank.

I claim:

1. Process for rounding, in a rounding apparatus, blanks which are fed to the apparatus in succession one immediately after another, comprising the steps of:

plastically deforming each blank in a rounding mechanism, moving each plastically deformed blank into a natural rounding position, and immediately after the rounding of each deformed blank is completed, shifting at least a rear end portion of the deformed blank into a transfer position which is different from the rounding position so that the rounding position is vacated by the shifted, deformed blank for occupation by at least a leading portion of the next incoming blank which is already in the process of being rounded before the shifted, deformed blank is ejected from the rounding apparatus.

2. Process according to claim 1, wherein guide means are provided in the rounding apparatus for guiding a blank from the rounding mechanism into the rounding position, further comprising the steps of:

elastically deforming at least a portion of a rounded part of the blank in the process of being rounded out of the rounding position by the guide means so that a portion of the blank running directly out of the rounding mechanism is kept under stress by deflection forces, and moving the elastically deformed blank from the rounding mechanism into the transfer position using said stress after the blank has completely passed through the rounding mechanism.

3. Process according to claim 1, further comprising the step of preventing the portion of the blank which is shifted into the transfer position by a holdback element from reverting to the rounding position.

4. Process according to claim 1, in which stop means are further provided in the rounding apparatus for stopping advancement of the blank, further comprising the step of arresting a front end of the blank running through the rounding mechanism with the stop means so that the blank is elastically deformed due to kinetic energy of a trailing portion of the blank, whereby its rear edge overshoots its natural end position to a predetermined extent owing to elastic deformation of the blank, and then springs back into the transfer position in which it is held by a holdback element.

5. Process according to claim 2, wherein a rounded portion of a blank in the process of being rounded first runs through a first path-segment corresponding to the rounding position and then runs into a second path-segment differing from the rounding position, so that a portion of the blank which is in the second path-segment is deflected out of the rounding position.

6. Process according to claim 3, wherein the step of preventing the rear end portion of the first blank from reverting to the rounding position comprises catching the rear portion of the blank shifting to the transfer position with the holdback element after the rear end portion of the first blank slips over the holdback element, wherein the holdback element is a barb.

7. Process according to claim 6, wherein the second path-segment lies between the corresponding segment of the natural rounding position and a center of curvature, and wherein the rounded blank after running through the rounding mechanism springs back, with its rear portion moving outwards, into the transfer position.

8. Apparatus for rounding deformable blanks in succession one immediately after the other, comprising a device for feeding blanks in a feed direction, a rounding mechanism for fully rounding each of the blanks, and an ejection mechanism for ejecting the fully rounded blanks from the rounding mechanism, wherein the ejection mechanism comprises means for shifting at least the rear end portion of a blank released from the rounding mechanism into a transfer position for transfer from the rounding mechanism by the ejection mechanism.

9. Apparatus according to claim 8, wherein the means for shifting comprises means for elastic deformation of a blank which is running, or has run, out of the rounding mechanism.

10. Apparatus according to claim 8, wherein the means for shifting comprises guide means for deflecting a front portion of a blank running out of the rounding mechanism out of its natural rounding position.

11. Apparatus according to claim 9, wherein the means for elastic deformation of the blank comprises an arresting arrangement for abruptly arresting advancement of the blank which is running, or has run, out of the rounding mechanism.

12. Apparatus according to claim 9, wherein the means for elastic deformation further comprises a holdback element for retaining at least the rear portion of the blank in the transfer position.

13. Apparatus according to claim 9, characterized in that the means for shifting the blank include a guide by means of which a front portion of the blank running out of the rounding mechanism is deflected out of its natural rounding position.

14. Apparatus according to claim 11, wherein the arresting arrangement for the blank and a holdback element for retaining at least the rear portion of the blank in the transfer position are allotted to the outer guide.

15. Apparatus according to claim 11, characterized in that the means for elastic deformation include a holdback element for retaining at least the rear portion of the blank in the transfer position.

16. Apparatus according to claim 12, wherein the holdback element has a curved support surface for limiting springy movement of the blank, due to elastic deformation of a released end portion of the blank beyond an ejection circle defining the transfer position, and further for accelerating engagement of the blank in a catch groove which is located at an end of the curved support surface near the transfer position.

17. Apparatus according to claim 10, wherein the guide means comprises an outer guide acting on a leading portion of the blank.

18. Apparatus according to claim 17, wherein the outer guide substantially surrounds an ejection circle defining the transfer position, the ejection circle having a radius equal to a bending radius defined by the rounding mechanism and further having a center offset with respect to a center of a bending circle corresponding to the natural rounding position.

19. Apparatus according to claim 18, wherein the outer guide together with an inner rounding mandrel form a circular slot for receiving a portion of the blank running out of the rounding mechanism, and wherein part of the circular slot is arranged as a guide slot for a leading portion of a blank which is to be elastically deformed, and wherein a cross-section of the inner rounding mandrel corresponds to a region of overlap between the ejection circle and the bending circle.

20. Apparatus according to claim 18 wherein the center of the ejection circle is offset in the feed direction with respect to the center of the bending circle.

21. Apparatus according to claim 19, wherein the outer guide has a polygonal configuration and the inner rounding mandrel has before the guide slot a guide region projecting beyond the bending circle for the portion of the blank running out of the rounding mechanism.

* * * * *